US006840736B2

(12) United States Patent
Ohtachi et al.

(10) Patent No.: US 6,840,736 B2
(45) Date of Patent: Jan. 11, 2005

(54) VACUUM PUMP

(75) Inventors: Yoshinobu Ohtachi, Narashino (JP); Hirotaka Namiki, Narashino (JP); Takaharu Ishikawa, Chiba (JP); Akira Yamauchi, Chiba (JP)

(73) Assignee: BOC Edwards Technologies Limited, Narashino (JP)

( * ) Notice: Subject to any disclaimer, the term of this patent is extended or adjusted under 35 U.S.C. 154(b) by 167 days.

(21) Appl. No.: 10/177,834

(22) Filed: Jun. 21, 2002

(65) Prior Publication Data

US 2003/0007862 A1 Jan. 9, 2003

(30) Foreign Application Priority Data

Jun. 22, 2001 (JP) ..... 2001-189448

(51) Int. Cl.[7] ..... F04D 19/04
(52) U.S. Cl. ..... 415/90; 415/119
(58) Field of Search ..... 415/90, 143, 214.1, 415/9, 119; 417/423.4

(56) References Cited

U.S. PATENT DOCUMENTS

| | | | | |
|---|---|---|---|---|
| 4,541,772 A | | 9/1985 | Becker | 415/90 |
| 4,926,648 A | * | 5/1990 | Okumura et al. | 62/55.5 |
| 5,446,275 A | * | 8/1995 | Sakai et al. | 250/207 |

FOREIGN PATENT DOCUMENTS

| | | |
|---|---|---|
| EP | 0220581 | 5/1987 |
| EP | 0768467 | 4/1997 |
| EP | 0875694 | 11/1998 |
| EP | 0931939 | 7/1999 |
| EP | 1118774 | 7/2001 |

* cited by examiner

*Primary Examiner*—Edward K. Look
*Assistant Examiner*—Richard A. Edgar
(74) *Attorney, Agent, or Firm*—Adams & Wilks

(57) ABSTRACT

Vibrations generated by a vacuum pump are prevented from propagating to external equipment such as an electron microscope. A casing (a separate casing portion and a casing main body) that houses a stator, stator blades, a rotor portion, and rotor blades as an exhaust function portion is connected to an inlet port portion in which an inlet port for sucking in a gas from the outside is formed, through an elastic member. An suction space between the casing and the inlet port portion is sealed by a bellows cylinder sealing means, and motion regulating members and motion regulating members and which regulate the amount of separation between the inlet port portion and the casing, and change shape due to relative motion between the two, are formed between the inlet port portion and the casing. The elastic member can maintain an appropriate amount of elastic force by means of the motion regulating members, good vibration reducing characteristics can be obtained at all times, and the propagation of vibrations to external equipment and the like, causing loss of function and endurance of the equipment, can be prevented. Further, plastic deformation and breakage of the elastic member and the sealing member can be prevented, and in addition, the vacuum pump can be prevented from running wild due to a sudden accident.

13 Claims, 3 Drawing Sheets

VACUUM PUMP

BACKGROUND OF THE INVENTION

1. Field of the Invention

The present invention relates to a vacuum pump that is connected to equipment such as an electron microscope, or a container, and used for sucking in a gas from the equipment.

2. Description of the Related Art

Conventionally, vacuum pumps used for evacuating a gas from equipment such as an electron microscope, from a container, or the like possess an inlet port portion having an inlet port formed on one end of a casing that houses an evacuation function portion, and an exhaust port portion formed on the other end. The inlet port portion is connected to external equipment or the like through piping or the like, and a gas from the outside is introduced to the inside of the casing from the inlet port portion. The following may be given as an example of the exhaust function portion housed in the inside of the casing: a rotor portion and a stator portion may be disposed, and an outer circumferential surface of one of the rotor portion and the stator portion may be arranged as opposing an inner circumferential surface of the other portion, forming a gas transport portion for transporting a gas between the rotor portion and the stator portion. The rotor portion may then be made to rotate by a driving means such as a motor, and a gas from the outside may be sucked in by transporting the gas in the gas transport portion to the exhaust side. With turbo molecular pumps, one type of vacuum pump, stator blades that project out toward the rotor portion are provided in the stator portion, for example. On the other hand, rotor blades that project out between the stator blades are provided in the rotor portion. Gas molecules are hit by the rotating rotor blades, and transported. Furthermore, screw threads are formed on one circumferential surface from among mutually opposing circumferential surfaces of a rotor portion and a stator portion in screw thread type pumps. Gas is transported due to rotation of a rotor, utilizing the viscosity of the gas. Further, there are also turbo molecular pumps that combine these two types.

Gas suction force is obtained by rotationally driving the rotor portion with the aforementioned vacuum pumps, and not a small amount of vibration is generated along with the rotation. The vibration propagates from the casing to the external equipment through the inlet port portion, the piping, and the like. Functionality and endurance of the external equipment is adversely affected due to the vibration. For example, there is a large influence on microscopic images in an electron microscope due to even a minute amount of vibration. Various types of measurements for improvements have been developed in order to prevent these vibrations from propagating from the vacuum pump to the external equipment and the like. For example, an improved vacuum pump was proposed in Utility Model Application 58-119648. This vacuum pump is characterized in that an inlet port portion that is a portion for connecting to an apparatus is separated from a casing, and the inlet port portion is coupled to the casing through an elastic member and sealing means, thus reducing the propagation of vibrations from the vacuum pump body to the apparatus. Further, a rubber member and an O-ring or a bellows can be given as the elastic member and the sealing means, respectively.

However, there are problems such as the following with conventionally improved vacuum pumps.

1-1 Piping or the like on the vacuum pump is in a hanging state when connected to external equipment, and therefore, the weight of the vacuum pump except for the inlet port portion acts on the elastic member and the bellows, generating permanent deformation in the elastic member and the bellows, if the inlet port portion is connected to an apparatus. In the worst case, there is a fear that fracture will occur, and therefore a supporting means for supporting the vacuum pump, except for the inlet port portion, from the outside is necessary.

1-2 During vacuum pump operation, if the rotating body breaks and an overly large load acts on the vacuum pump body due to causes such as impacts and vibration from the outside, creep and corrosion of the rotating body, and the mixing in of foreign matters from the apparatus to the inside of the vacuum pump, then the elastic member and the sealing means coupled to the inlet port portion and the vacuum pump body (casing) may break, the airtightness of the inside of the vacuum pump may be harmed, the connection of the vacuum pump body to the apparatus may be lost, and there is a fear that this may cause the vacuum pump to run wild, leading to a significant accident.

1-3 For cases in which a rubber member is used as the elastic member, a compressive load is added to the rubber member by the pressure difference between the inside and the outside of the vacuum PUMP If this results in a state in which the rubber member is compressed too much, then the modulus of longitudinal elasticity and the modulus of transverse elasticity of the rubber member will become larger due to the properties of the rubber portion, and the vibration reducing characteristics will be deteriorated.

With the aforementioned circumstances as a background, an object of the present invention is to provide a vacuum pump capable of satisfactorily maintaining the vibration reducing characteristics of an elastic member, capable of preventing fracture and damage to the elastic member and to a sealing member, and in addition, able to prevent accidents from happening due to the pump running wild.

SUMMARY OF THE INVENTION

In order to achieve the above-mentioned object, according to one aspect of the present invention, there is provided a vacuum pump including a casing for housing and exhaust function, and an inlet port portion provided with an inlet port for sucking in a gas from outside and connected to the casing so that the gas is transported to the exhaust function portion through the inlet port. The inlet port portion and the casing are connected through an elastic member with a gap, and an inlet space formed therebetween is sealed by sealing. A motion regulating member for regulating the separation distance that varies in accordance with a relative motion of the inlet port portion and the casing is provided between the inlet port portion and the casing.

According to another aspect of the present invention, there is provided a vacuum pump characterized in that the sealing means is made up of a bellows cylinder; and two ends of the cylinder are fixed to the inlet port portion and the casing, respectively, so that suction space between the inlet port and the casing is surrounded by a cylinder wall thereof.

According to a further aspect of the present invention, the motion regulating member regulates a separation distance between the inlet port portion and the casing so that it is equal to or less than a set value.

According to another aspect of the present invention, the elastic member is made up of a cylindrical shape rubber member disposed coaxially in an outer circumference of the bellows cylinder.

According to a further aspect of the present invention, the elastic member is made up of a rubber member; and the rubber member has a quality of material and a shape so that the Young's modulus E, and an active area A of a compressive load P, which acts on the rubber member due to a pressure difference between an inside and an outside of the vacuum pump when the vacuum pump is operating, satisfy the following formula:

$$\Delta t/t=P/(E\cdot A)\leqq 0.5,$$

where t denotes the thickness of the rubber member in the compression direction, and Δt denotes an amount of contraction in a thickness direction of the rubber member that develops due to the compressive load P acting on the rubber member.

According to another aspect of the present invention, the motion regulating member has a latching portion that is fixed to one of the inlet port portion and the casing and that regulates an additional relative motion of the inlet port portion and the casing by being latched together with another portion thereof in accordance with the spacing position therebetween.

According to a further aspect of the present invention, the motion regulating member is provided with a floating shaft portion that is fixed to the one of the inlet port portion and the casing and passes freely through a through-hole formed in the another portion thereof, and a latching head portion having a size that exceeds that of the through-hole formed on a tip side of the through-hole of the shaft portion.

According to another aspect of the present invention, the motion regulating member is composed of opposed abutting portions that are formed so as to face the inlet port portion and the casing, respectively, with a predetermined distance spaced apart from each other.

According to another aspect of the present invention, the motion regulating member passes through the elastic member.

According to a further aspect of the present invention, the inlet port portion is provided with a protective net covering an opening portion of the inlet port, and the protective net is made up of a magnetic member.

According to another aspect of the present invention, the casing is made up of a magnetic member.

Namely, in accordance with the present invention, plastic deformation of and damage to the elastic member and the sealing member are prevented by the motion regulating member, the elastic member can maintain a proper amount of elastic force, and good vibration reducing characteristics can be displayed. Vibrations generated by a bearing portion or a motor portion can therefore be reduced by the elastic member, and this can effectively prevent vibrations form propagating to external equipment, containers, and the like, preventing damage to the functionality of the external equipment and preventing damage to their endurance.

Further, along with the increase in the equipment endurance, the vacuum pump can be prevented from running wild due to sudden accidents.

Note that although a turbo molecular pump is preferably applied as the vacuum pump of the present invention in order to make a high vacuum in external equipment and the like, the present invention is not limited to the turbo molecular pump. There are therefore no particular limitations placed on the structure of the exhaust function portion of the vacuum pump. Further, although a large effect is exhibited for cases in which the vacuum pump of the present invention is used for electron microscopes whose functionality is particularly influenced by vibration, the present invention is not limited to being used as such. It is possible to apply the present invention to a variety of uses.

Furthermore, provided that the exhaust function portion can suck in a gas from the external equipment or the like, creating a vacuum state, there are no limitations placed on the structure of the exhaust function portion as stated above with the present invention. For example, a positive displacement type may be used, and a turbo type may also be used.

Taking as an example the exhaust function portion of the turbo molecular pump that is one type of vacuum pump, one provided with a rotor portion, a stator portion that along with the rotor portion forms a portion for transporting a gas, a magnetic bearing for supporting the rotor portion in the thrust direction and in the radial direction with respect to the stator portion, and a motor portion for rotating the rotor portion with respect to the stator portion.

A casing houses the exhaust function portion, maintains the airtightness of its inside portion, is coupled to an inlet port and an outlet port, and also satisfies a function as a passageway for transporting a gas.

Various materials can be utilized as the elastic member, and rubber members having high heat resistance characteristics, for example silicone rubber and fluorine rubber, can be given as suitable materials. The reason that it is desirable to use materials having high heat resistance characteristics is that, in order to increase the vacuum level within the vacuum pump, a baking heater is attached to the vacuum pump, heating the inside, and the vacuum pump becomes warmer due to frictional heat that develops between the rotating blades and the exhausted gas during vacuum pump operation, heat generated by the magnetic bearing and a motor, and the like. With a rubber material having low heat resistance characteristics, its elasticity drops and its vibration reducing characteristics are deteriorated.

Further, the elastic member is not limited to the aforementioned rubber member, and a spring member and a gel member that is made up of a gel material may also be used. Leaf springs, coil springs, and coned disk springs can be given as spring members, gel members and the like made up of a gel material such as silicone can be given as gel members.

It is desirable that the elastic member be a cylindrical shape disposed concentrically on the outer circumference of a bellows cylinder. This is because a compressive load is generated by the gas pressure difference between the inside and the outside of the vacuum pump during vacuum pump operation. To ensure that permanent deformation does not develop in the rubber member even if the compressive load also acts on the rubber member, conventionally, the quantity of the rubber members has to be increased in order to make the compressive load acting per one rubber member smaller. The number of components and the number of assembly processes for the vacuum pump are increased, and the cost of the vacuum pump is increased. By making the elastic member into a cylindrical shape as stated above, the quantity of rubber members can be reduced, and it becomes possible to reduce the number of components and assembly processes for the vacuum pump, and to lower the cost of manufacturing the vacuum pump. Further, the compression load and the like can be received uniformly by the elastic member, and the vibration reducing characteristics become very effective.

In addition, it is desirable that the rubber member have material properties and a shape such that its Young's modulus E, and an active area A over which a compressive load P acts on the rubber member due to the pressure difference between the inside and the outside of the vacuum pump during vacuum pump operation, satisfy the aforementioned formula. The Young's modulus does not increase greatly, even if the compressive load acts on the rubber material during vacuum pump operation, if the rubber material satisfies these conditions, and therefore the elastic member displays good elastic characteristics, and excellent vibration reducing characteristics can be obtained.

Further, the inlet port portion that has the inlet port is connected to the casing through the elastic member, and it becomes possible to absorb vibrations by elastic deformation of the elastic member due to the distance from the casing. The distance between the inlet port portion and the casing normally follows the suction direction.

A suction space formed between the inlet port portion and the casing is maintained in an airtight manner by sealing means. The elastic member may be also used as the sealing means, and another member may be used. Note that it is desirable that the sealing means have as low a vibration transmissibility as possible, and the bellows cylinder can be shown to be optimal as the sealing means. With the cylinder, the suction space can be maintained in an airtight manner by the cylinder walls in accordance with the cylinder surrounding the suction space. The bellows cylinder easily undergoes elastic deformation with the aforementioned vibrations,and also acts to absorb a portion of the vibration.

In order to maintain airtightness, the bellows cylinder is connected to the inlet port portion and the casing by welding or the like. However, on the casing side, the casing is large, and therefore the welding workability, the transport efficiency after welding and the disassembly and assembly characteristics of of the vacuum pump after welding are deteriorated, and this easily invites an increase in the cost of manufacturing the vacuum pump as a result. Therefore, it is desirable that a separate casing portion, to which the elastic member and the sealing means are attached, be separated from a casing main body within which the exhaust function portion is housed. The attachment of the bellows cylinder thus becomes easy to perform, the transport efficiency after welding and the disassembly and assembly characteristics after welding are increased, and it becomes possible to reduce the manufacturing cost. The casing main body an the separate casing portion, which are separated, are coupled in an airtight manner through an O-ring or the like.

In addition, the inlet port portion and the casing move relative to each other with the present invention, and a motion regulating member for regulating the amount of change in the distance of separation between the two is formed between the inlet port portion and the casing. Relative motion between the two is as follows:

(1) The inlet port portion and the casing are normally in a state of hanging down when connected to external equipment, and the lower positioned casing moves downward due to its own weight.

(2) During vacuum pump operation, the casing is pulled over to the inlet port portion side due to the gas pressure difference between the inside and the outside of the vacuum pump, thus moving.

(3) There is a concern that the elastic member or the sealing means coupling the inlet port portion and the casing may be destroyed due to a sudden accident, and thus the vacuum pump may run wild.

With the present invention, the motion conditions are assumed, and the amount of change of the separation distance between the inlet port portion and the casing is regulated in concert with at lest one of the motion conditions. In the (1) case, the maximum amount of separation is limited so that an excess tensile force does not reach the elastic member. The amount of downward motion of the casing is thus limited, the elastic member. The amount of downward motion of the casing is thus limited, the elastic member can be prevented from receiving an unnecessary load, damage to the endurance and the development of permanent deformation can be prevented, and in addition, the elastic member can be prevented from fracturing. Further, an excess tensile load will not act in the axial direction on a sealing member of the bellows cylinder and the like, the bellows cylinder and the like can be prevented from undergoing plastic deformation, reducing its vibration reducing characteristics, and breaking, and the airtightness of the inside of the vacuum pump can be prevented from being lost. Further, it becomes unnecessary to support the vacuum pump from the outside.

In the (2) case, the minimum amount of separation is limited so that an excess compressive force does not reach the elastic member, and in addition, compressive breakage can be prevented. Further, an excess compressive load will not act in the axial direction on the sealing member of the bellows cylinder and the like, the bellows cylinder and the like can be prevented. Further, an excess compressive load will not act in the axial direction on the sealing member of the bellows cylinder and the like, the bellows cylinder and the like can be prevented from undergoing plastic deformation, reducing its vibration reducing characteristics, and breaking, and the airtightness of the inside of the vacuum pump can be prevented form being lost.

In the (3) case, the amount of a motion of the inlet port portion, and the amount of motion of the casing are limited as so that separation between the two is prevented. It is thus possible to prevent the elastic member and the sealing means from being damaged, the airtightness of the inside of the vacuum pump from being lost, the connection of the vacuum pump main body to an apparatus from being released, and the vacuum pump from running wild, leading to a serious accident, even if a rotating body breaks and an excess force acts on the vacuum pump. The limitation of the aforementioned (1) can also be utilized for the (3) case.

There are no particular limitations placed on the structure of the motion regulating member, provided that it is a structure in which at least one of the above-stated actions is obtained. The motion regulating member may accomplish one of the aforementioned plurality of actions, and further, a plurality of motion regulating members may be formed, accomplishing the respective actions.

The following may be given as an example of the motion regulating member. A motion regulating member is fixed to one location, either the inlet port portion or the casing, and has a latching portion that is latched together with the other location of the inlet port portion and the casing portion for regulating the additional relative motion between the inlet portion and the casing in accordance with the separated positions of the two.

Specifically, the motion regulating member may be one that is fixed to one location, either the inlet port portion or the casing, and is provided with a floating shaft portion that passes freely through a through-hole formed in the other location, and a latching head portion having a side that exceeds the through-hole formed on a tip side of the through-hole of the shaft portion. The motion regulating member has a bolt shape, for example it may be screwed into a screw hole formed in the casing and thus fixed and the head portion may be positioned in the upper portion of the through-hole of the inlet port portion and utilized as the latching head portion.

Motion with respect to the aforementioned (1) and (3) can be controlled in accordance with the above-stated structure. The space required in order to attach the motion regulating member to the inlet portion and the casing can be made smaller in accordance with the motion regulating member passing through the elastic member, and the vacuum pump can be made small size.

A motion regulating member having opposed abutting portions opposing a predetermined distance between the two, can be employed as another motion regulating member. In accordance with this member, if the amount of separation distance between the inlet port portion and the casing is reduced to a set value then the abutting members contact each other, and the inlet port portion and the casing are prevented from approaching any closer to each other. An excess compressive force can be prevented from being applied to the elastic member and the sealing member, plastic deformation and breakage can be prevented, and a loss in the vibration reducing characteristics can be prevented. Note that he opposed abutting portions may be fixed to the inlet port portion and the casing by welding, being screwed in, or the like, and further, may also be formed as integrated with the inlet port portion and the casing, respectively.

Furthermore, the motion regulating member can be disposed so as to pass through the elastic member, as stated in claim 11. An extra space needed to dispose the motion regulating member is thus not necessary, and size reduction of the vacuum pump becomes possible.

Further, the inlet port portion may be provided with a protective net covering an opening portion of the inlet port portion in order to prevent foreign matters from mixing into the inside portion of the vacuum pump from external apparatuses and the rotation blades from being damaged, and it is desirable that the protective net be made up of a magnetic material such as permalloy. Magnetic flux that leaks upward in the axial direction of the rotor portion from the motor inside the vacuum pump, the magnetic bearing, or the like, is thus restricted within the protective net, and magnetic flux does not leak out to the external equipment. The performance, reliability, lifetime and the like of the external equipment can therefore be prevented from being deteriorated. The protective net may cover a portion of the opening portion, but it is desirable that it cover the entire opening portion in order to reliably achieve the aforementioned effect. Further, the protective net may be made up of wire rods of a magnetic material such as permalloy, and may also be manufactured by etching a sheet material of the magnetic material. It is desirable that the magnetic member be a ferromagnetic substance such as permalloy.

Furthermore, the casing may be made up of a magnetic member such as a permalloy. Magnetic flux that leaks toward the radial direction of the rotor portion from the motor inside the vacuum pump, the magnetic bearing, or the like, is thus restricted within the casing, and magnetic flux does not leak out to the external equipment. The performance, reliability, lifetime and the like of the external equipment can therefore be prevented from being deteriorated. It is desirable that the magnetic member also be a ferromagnetic substance such as a permalloy, similarly to the protective net.

DESCRIPTION OF THE PREFERRED EMBODIMENT

An embodiment mode of the present invention is explained below based on attached figures.

Figure 1:
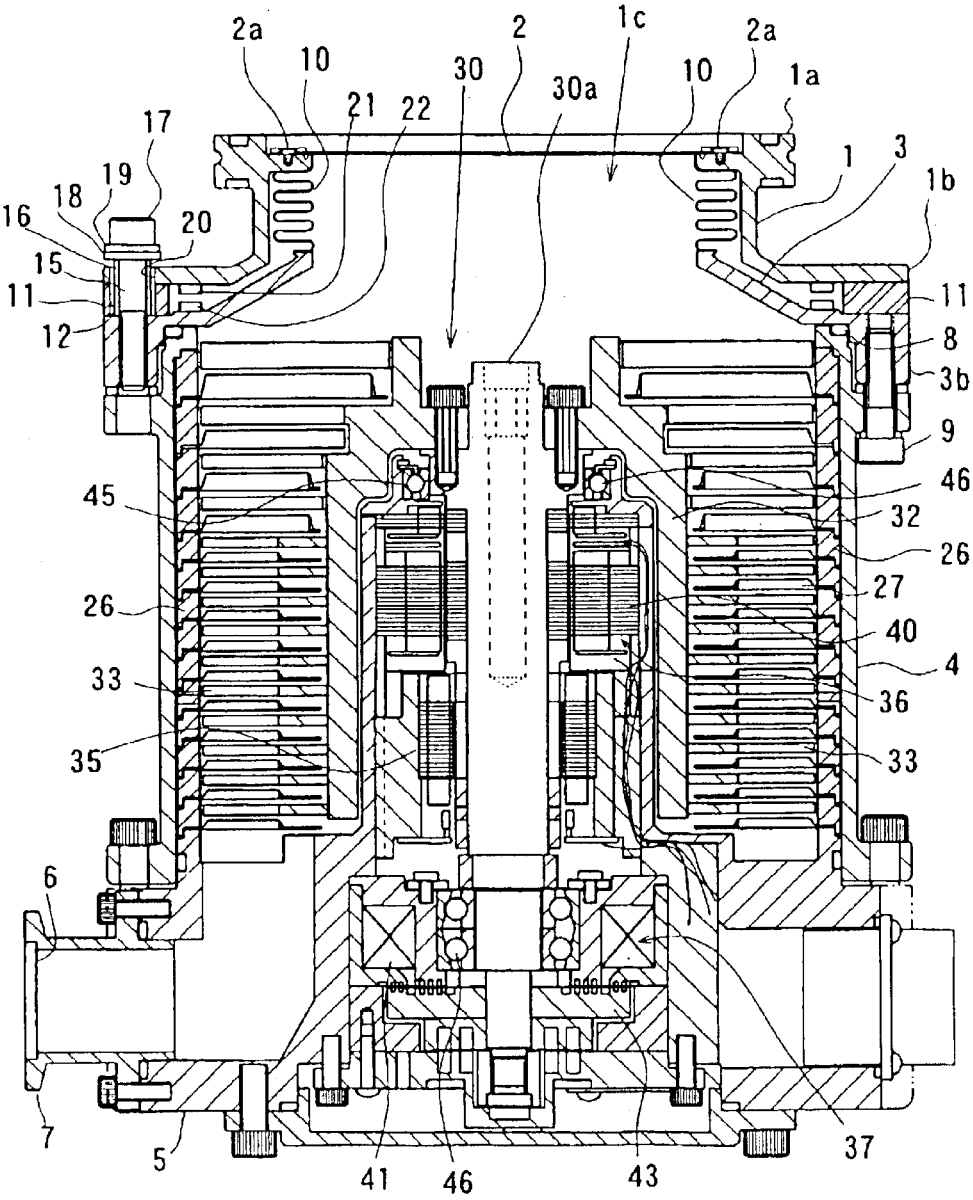
FIG. 1 is a frontal cross sectional diagram showing an embodiment mode of a vacuum pump of the present invention.
Figure 2:
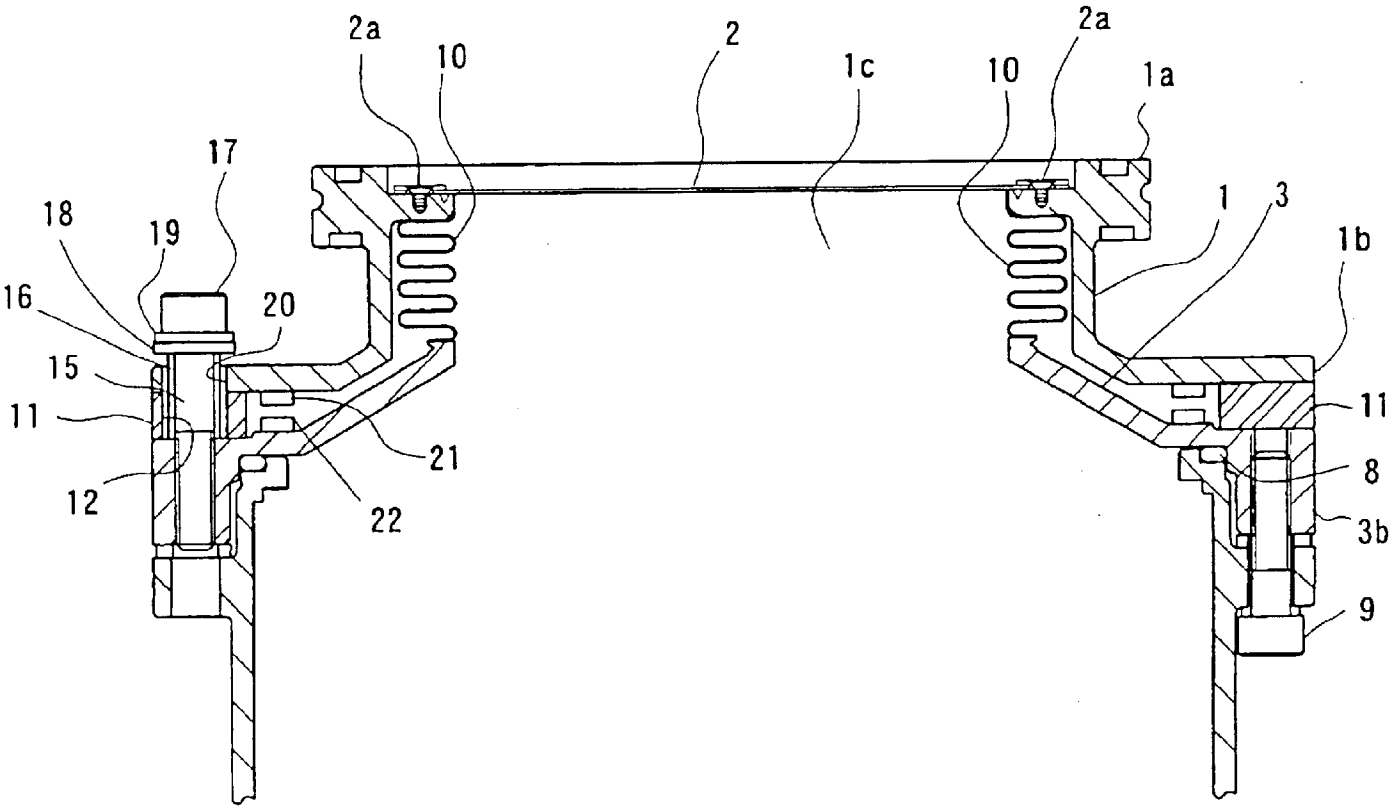
FIG. 2 is an enlarged cross sectional diagram showing an inlet port and a separate casing portion of the embodiment of the vacuum pump of the present invention.
Figure 3:
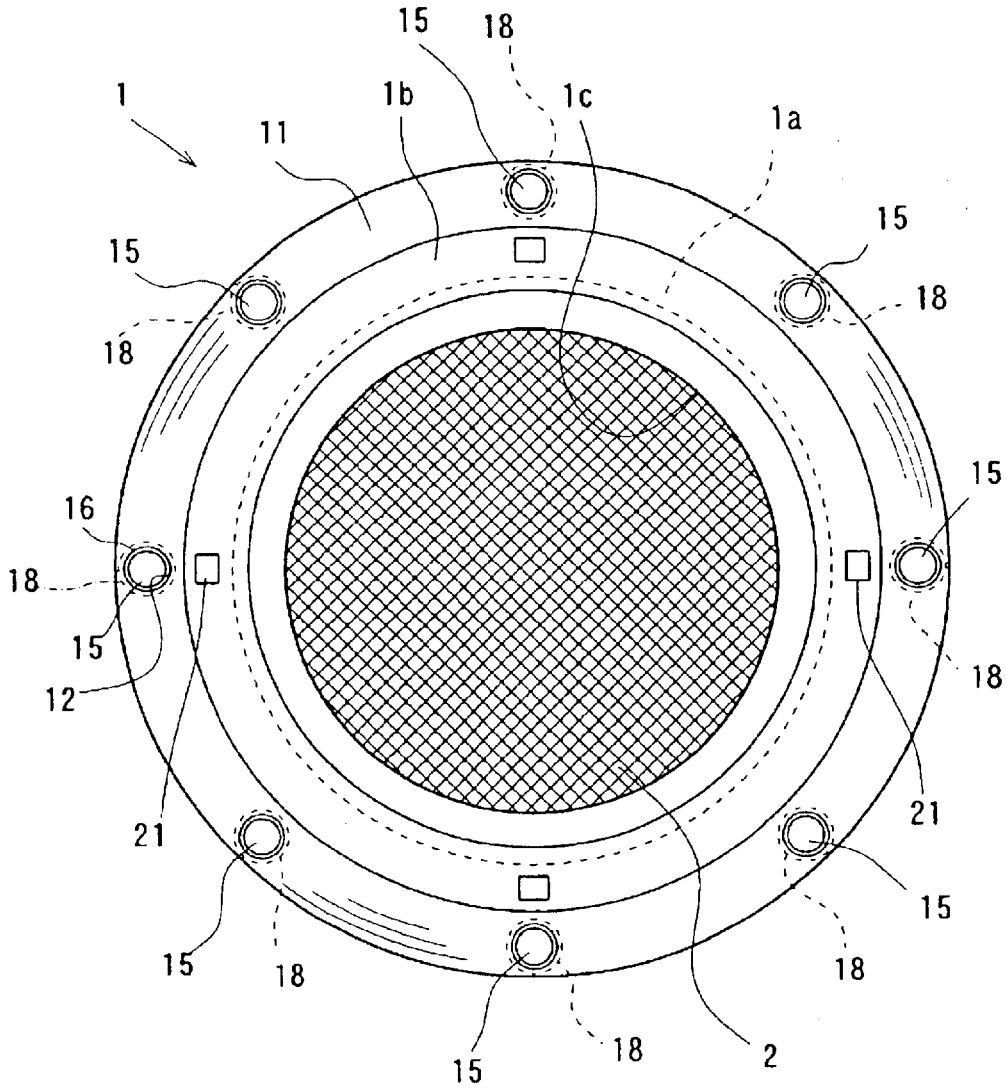
FIG. 3 is a rear view diagram showing the inlet port of FIG. 1.

FIG. 1 is a longitudinal cross sectional diagram showing an entire structure of a turbo molecular pump as an embodiment mode of a vacuum pump of the present invention, FIG. 2 is an enlarged cross sectional diagram of a periphery of an inlet port portion, and FIG. 3 is a rear view diagram of the inlet port portion periphery.

A vacuum pump (turbo molecular pump) of this embodiment mode has a cylindrical shape inlet port portion 1 formed connecting to an external container, in which an inlet port 1*c* is formed in order to suck in a gas from within the external container, a separate casing portion 3 made up of a different body than the inlet port portion 1 and formed as an external cylinder portion for connecting to one end of the inlet port portion 1, and a cylindrical shape casing main body 4 structuring a casing together with the separate casing portion 3.

The inlet port 1 is made from stainless steel and an attachment portion 1*a* extends outwards in the radial direction on top of the inlet port portion 1. The attachment portion 1*a* is fixed to a periphery portion of an exhaust port of an external container. Further, there is a flange shape on the bottom, and a portion to be supported 1*b* is formed in a circumferential end portion. The portion to be supported 1*b* is placed between the attachment portion 1*a* and the separate casing portion 3, in an axial direction of the separate casing portion 3, and is disposed above (on the external container side) an inlet port portion support portion 3*b* of the separate casing portion 3.

The casing main body 4 similarly has a cylindrical shape manufactured by stainless steel, and has a built-in exhaust function portion as described later. Note that the separate casing portion 3 and the casing main body 4 are fixed by a bolt 9, sandwiching an O-ring 8.

A base 5 is coupled to the other end side of the casing 4 (the casing main body 4 is fixed to and supported by the base 5), and along with the inlet port portion 1, the separate casing portion 3, and the casing main body 4, the base 5 forms a hollow portion coupled to the inside of the external container through the inlet port 1*c*. Further, an exhaust port portion 7, in which the exhaust port 6 for exhausting a gas within the hollow portion is formed, is attached to the base 5.

Note that a protective net 2 that covers the entire opening portion of the inlet port 1*c* is disposed in the inlet port portion 1, and that a circumferential end portion of the protective net 2 is fixed to the inlet port portion 1 by a countersunk screw 2*a*.

The protective net 2 is made up of a magnetic member such as permalloy. Foreign matters can thus be prevented from mixing into the inside portion of the vacuum pump from external apparatuses, and in addition, magnetic flux that leaks upward in the axial direction of a rotor portion from a motor inside the vacuum pump, a magnetic bearing, or the like, is thus restricted within the protective net 2. The magnetic flux can thus be prevented from influencing the external apparatuses.

A bellows cylinder 10 is disposed between the inlet port portion 1 and the separate casing portion 3 so as to surround a suction space, and the ends of the bellows cylinder 10 are fixed by welding to the inlet port portion 1 and to the separate casing portion 3, respectively. Note that the bellows cylinder 10 is welded to the separate casing portion 3 which is much smaller than the casing main body 4, and therefore the welding procedure can be performed efficiently, and equipment handling also becomes easy.

Further, a cylindrical shape elastic member 11 made from silicone rubber or fluorine rubber is disposed between the portion to be supported 1*b* of the inlet port portion 1 and the inlet port portion support portion 3*b* of the separate casing 3, coaxially with the bellows cylinder 10. The end portions of the elastic member 11 contact the inlet port portion 1 and the separate casing portion 3, respectively. The inlet port portion 1 and the separate casing portion 3 are therefore linked by the bellows cylinder 10 and the elastic member 11.

Note that the elastic member 11 is one in which the value of P/(E·A) is less than 0.5, obtained by calculating with the Young's modulus E of the elastic member and the active area A of a compressive load P which acts on the elastic member 11 due to the pressure difference between the inside and the outside of the vacuum pump during vacuum pump operation. That is, taking an example of a case of using silicone rubber as the elastic member 11, the compressive load is 2450 N, the Young's modulus E is 294 $N/cm^2$, and the active cross sectional surface area A is 50 $cm^2$, and the result of calculating as stated above becomes 0.16.

Further, a floating shaft portion 15 is screwed into and fixed to the separate casing portion 3 as one of motion control means for regulating the amount of separation between the inlet port portion 1 and the separate casing portion 3 to be within a predetermined range. A collar 16 is mounted to the outer circumference of the floating shaft portion 15. The floating shaft portion 15 to which the collar 16 is mounted passes freely through a through-hole 12 formed in the elastic member 11 along the axial direction of the cylinder, in addition, passes freely through a through-hole 20 formed in the inlet port portion 1 and has a latching head portion 17 further above the inlet port portion 1. Note that reference numeral 18 shown in the figures denotes a washer, and 19 denotes a flat washer. The latching head portion 17, the washer 18, and the flat washer 19 are formed having diameters larger than that of the through-hole 20, and the head portion 17, the washer 18, and the flat washer 19 are stopped from passing through the through-hole 20. Therefore, if the inlet port portion 1 and the separate casing portion 3 are further separated, and the amount of separation reaches a certain amount, then the head portion 17 hits an upper surface of the inlet port portion 1, through the washer 18 and the flat washer 19, and the inlet port portion 1 and the separate casing portion 3 are prevented from separating by a greater amount.

Further, the opposed abutting portions 21 and 22 are formed protruding from opposing surfaces in the axial direction (in the vacuum pump) of the inlet port portion 1 and the separate casing portion 3, respectively, as motion regulating members. By suitably determining the height by which the opposed abutting portions 21 and 22 protrude, the opposed abutting portions 21 and 22 will come into mutual abutment if the inlet port portion 1 and the separate casing portion 3 approach each other and the amount of their separation drops to a certain amount. The inlet port portion 1 and the separate casing portion 3 are thus prevented from getting closer together.

In addition, the casing main body 4 is provided with a stator portion 26, supported by the base 5 and housed within the hollow portion, which is a portion of an exhaust function portion, and a rotor portion 30 housed within the hollow portion.

Further, the casing main body 4 is provided with magnetic bearing portions 36 and 37 for bearing the rotor portion 30 such that it is capable of rotating with respect to the stator portion 26, and a motor 35 which rotates the rotor portion 30, supported by the magnetic bearing portions 36 and 37, with respect to the stator portion 26 through a rotor shaft 30*a*.

The rotor portion 30 has a cylindrical shape wall portion 32, and a plurality of rotor blades 33 are formed radially and in multiple stages in the axial direction on the outer circumference of the cylindrical shape wall portion 32. The rotor blades 33 are inclined with respect to the axial direction at a predetermined angle so that the inlet port side (top side of the page) becomes the direction of rotation.

On the other hand, the stator portion 26 is provided with stator blades 27 that are disposed between each stage of the rotor blades 33. The stator blades 27 are inclined with respect to the axial direction at a predetermined angle. Gas molecules are hit down to the exhaust port 6 side by the action of the rotor blades 33 and the stator blades 27 when the rotor portion 30 is rotationally driven by the motor 35.

A magnetic bearing for supporting the rotor portion 30 by magnetic force is a three-axle control magnetic bearing, and the rotor shaft portion 30 is magnetically levitated in the radial direction (radial direction of the rotor shaft 30*a*) and supported without contact by the magnetic bearing portion 36. The rotor portion 30 is magnetically levitated in the thrust direction (axial direction of the rotor shaft 30*a*) and supported without contact by the magnetic bearing portion 37.

In the magnetic bearing portion 36, four radial direction electromagnets 40 are disposed in the periphery of the rotor 30*a* every 90 degrees so as to oppose each other (two are shown in the figures). The rotor shaft 30*a* opposing the magnets is made up of a material having high magnetic permeability, and receives magnetic force from the electromagnets.

A disk shaped metal disk 43 is fixed to a lower portion of the rotor shaft 30*a* by a magnetic material, and an axial direction electromagnet 41 is disposed on the metal disk 43 and fixed to the base 5.

The rotor portion 30 is then magnetically levitated by supplying an excitation current to the radial direction electromagnet 40 and the axial direction electromagnetic 41, respectively.

Further, protective bearings 45 and 46 are disposed in upper portion and lower portion sides of the rotor portion 30 with the turbo molecular pump of this embodiment mode.

The rotor portion 30 is normally supported axially in a non-contact state by the magnetic bearings while rotating. The protective bearings 45 and 46 substitute for the magnetic bearings for cases in which touchdown develops, supporting the rotor portion 30 axially and thereby protecting the entire apparatus.

Note that although the rotor portion 30 is supported axially by the magnetic bearings in this embodiment mode, the support is not limited to these, and dynamic bearings, static bearings, and other bearings may also be used.

Operation of this embodiment mode is explained next.

The turbo molecular pump is fixed to the external container through the attachment portion 1*a* of the inlet port portion 1, and driven by the motor 35. The rotor blades 33 rotate at high speed along with the rotor portion 30 due to the motor drive. Gas from the inlet port 1*c* is thus transported by the rotor blades 33 and the stator blades 27, and exhausted from the exhaust port 6.

Vibrations are generated while the turbo molecular pump is being driven due to imbalances of the rotor portion 30, cogging of the motor 35, and other causes. The vibrations are propagated to the casing main body 4 and the separate casing portion 3.

Further, in such a case where a back pump is connected to the exhaust port portion 7 of the turbo molecular pump, vibrations and the like from the back pump propagate similarly to the casing main body 4 and the separate casing portion 3 through connection piping and the like.

If the vibrations are transmitted from the separate casing portion 3 to the elastic member 11 and the bellows cylinder 10, the vibrations are greatly attenuated by elastic deformation of the elastic member 11 and the bellows cylinder 10, after which the vibrations are transmitted to the inlet port portion 1.

As described above, the inlet port portion 1 formed as a separate body from the casing is supported by the elastic member 11 and the bellows cylinder 10 in this embodiment mode, and therefore vibrations developing in the magnetic bearings due to the motor on the inside of the pump and due to imbalances in the rotor portion 30, vibrations due to external factors such as vibrations propagating from the back pump or other members during turbo molecular pump operation, and the like are all attenuated by the elastic member 11 and the bellows cylinder 10, after which the vibrations propagate to the inlet port portion 1. As a result, propagation to external containers and the like is reduced, and vibration of the external containers and the like can be suppressed.

Further, displacement with respect to the casing of the inlet port portion 1 is restricted within a predetermined range by the motion regulating member in this embodiment mode, and therefore deformation of the elastic member 11 and the bellows cylinder 10 can be contained within the elastic deformation range showing good vibration reducing characteristics, and excellent vibration reducing characteristics can be displayed at all times. Further, the elastic member 11 and the bellows cylinder 10 can be prevented from plastic deformation and the like to prevent breakage, and damage to endurance.

In addition, it is difficult for the inlet port portion 1 to separate from the casing even if a large load acts due to breakage of the rotor portion during rotation or the like, the danger that the turbo molecular pump will run wild is reduced, and it becomes possible to ensure a high level of safety.

Note that although the vacuum pump is a turbo molecular pump provided with the rotor blades and the stator blades in this embodiment mode, there can also be used a screw thread type pump, in which the rotor main body or the stator main body is given screw threads and a gas is transported by rotating the rotor portion and utilizing the viscosity of the gas, and a compound pump of the turbo molecular pump and the screw thread type pump.

Further, the floating shaft portion having the latching head portion and the abutting member are explained as the motion regulating member in this embodiment mode, but there is no need to limit the structure and the shape of the motion regulating member to such in the present invention. In addition, a rubber member is explained as the elastic member, and a bellows cylinder is explained as the sealing member in this embodiment, but similarly to what is stated above, the structure and the material properties of the elastic member and the sealing member are not limited to such.

As explained above, in accordance with the vacuum pump of the present invention the vacuum pump includes the casing for housing the exhaust function portion, and the inlet port portion provided with the inlet port for sucking in the gas from outside and connected to the casing so that the gas is transported to the exhaust function portion through the inlet port. The inlet port portion and the casing are connected through the elastic member with the gap, and the inlet space formed therebetween is sealed by sealing means. The motion regulating member for regulating the separation distance that varies in accordance with the relative motion of the inlet port portion and the casing is provided between the inlet port portion and the casing. The elastic member therefore maintains an appropriate amount of elastic force so that good vibration reducing characteristics can be obtained, and the function and endurance of external equipment and the like can maintained. Further, plastic deformation and breakage of the elastic member and the sealing member are prevented, equipment endurance is increased, and the vacuum pump can be prevented from running wild due to a sudden accident.

What is claimed is:

1. A vacuum pump comprising:

a casing for housing an exhaust function portion;

an inlet port portion provided with an inlet port for sucking in a gas from outside and connected to the casing so that the gas is transported to the exhaust function portion through the inlet port; wherein the inlet port portion and the casing are connected through an elastic member with a gap, and an inlet space formed therebetween is sealed by sealing means; and a motion regulating member for regulating the separation distance that varies in accordance with a relative motion of the inlet port portion and the casing, is provided between the inlet port portion and the casing.

2. A vacuum pump according to claim 1, wherein the sealing means is made up of a bellows cylinder; and two ends of the cylinder are fixed to the inlet port portion and the casing, respectively, so that suction space between the inlet port and the casing is surrounded by a cylinder wall thereof.

3. A vacuum pump according to claim 1, wherein the casing is made up of a separate casing portion to which the elastic member and the sealing means are attached, and a casing main body in which the exhaust function portion is housed; and the separate casing portion and the casing main body are airtightly coupled to each other.

4. A vacuum pump according to claim 1, wherein the elastic member is made up of a cylindrical shape rubber member disposed coaxially in an outer circumference of the bellows cylinder.

5. A vacuum pump according to claim 1, wherein the elastic member is made up of a rubber member; and the rubber member has a quality of material and a shape so that the Young's modulus E, and an active area A of a compressive load P, which acts on the rubber member due to a pressure difference between an inside and an outside of the vacuum pump when the vacuum pump is operating, satisfy a formula as follows:

$$\Delta t/t = P/(E \cdot A) \leqq 0.5,$$

where t denotes the thickness of the rubber member in the compression direction, and Δt denotes an amount of contraction in a thickness direction of the rubber member that develops due to the compressive load P acting on the rubber member.

6. A vacuum pump according to claim 1, wherein the motion regulating member regulates a separation distance between the inlet port portion and the casing so that it is equal to or less than a set value.

7. A vacuum pump according to claim 1, wherein the motion regulating member regulates the separation distance between the inlet port portion and the casing so that it is equal to or more than the set value.

8. A vacuum pump according to claim 1, wherein the motion regulating member has a latching portion that is fixed to one of the inlet port portion and the casing and that regulates an additional relative motion of the inlet port portion and the casing by being latched together with another portion thereof in accordance with the spacing position therebetween.

9. A vacuum pump according to claim 1, wherein the motion regulating member is provided with a floating shaft portion that is fixed to the one of the inlet port portion and the casing and passes freely through a through-hole formed in the another portion thereof, and a latching head portion having a size that exceeds that of the through-hole formed on a tip side of the through-hole of the shaft portion.

10. A vacuum pump according to claim 1, wherein the motion regulating member is composed of an opposed abutting portions that are formed so as to face the inlet port portion and the casing, respectively, with a predetermined distance spaced apart from each other.

11. A vacuum pump according to claim 1, wherein the motion regulating member passes through the elastic member.

12. A vacuum pump according to claim 1, wherein the inlet port portion is provided with a protective net covering an opening portion of the inlet port; and the protective net is made up of a magnetic member.

13. A vacuum pump according to claim 1, wherein the casing is made up of a magnetic member.

* * * * *